US005503014A

United States Patent [19]

Griffith

[11] Patent Number: 5,503,014

[45] Date of Patent: Apr. 2, 1996

[54] METHOD AND APPARATUS FOR TESTING WELLS USING DUAL COILED TUBING

[75] Inventor: Michael J. Griffith, Needville, Tex.

[73] Assignee: Schlumberger Technology Corporation, Houston, Tex.

[21] Appl. No.: 281,954

[22] Filed: Jul. 28, 1994

[51] Int. Cl.[6] ..... F21B 43/00; F21B 21/00

[52] U.S. Cl. ..... 73/155; 166/311; 166/250.17

[58] Field of Search ..... 73/155, 151; 166/250, 166/295, 305 R, 315, 297, 277, 305

[56] References Cited

U.S. PATENT DOCUMENTS

| | | | |
|---|---|---|---|
| 2,261,292 | 11/1941 | Salnikov | 166/21 |
| 2,548,616 | 4/1951 | Priestman et al. | 255/4 |
| 3,116,781 | 1/1964 | Rugeley et al. | 153/54 |
| 3,346,045 | 10/1967 | Knapp et al. | 166/0.5 |
| 3,373,816 | 3/1968 | Cochran | 166/46 |
| 3,525,401 | 8/1970 | Hanson et al. | 166/315 |
| 3,630,640 | 12/1971 | McMurray | 417/54 |
| 3,706,344 | 12/1972 | Vann | 166/297 |
| 3,717,095 | 2/1973 | Vann | 102/21.6 |
| 3,722,589 | 3/1973 | Smith et al. | 166/250 |
| 3,722,594 | 3/1973 | Smith et al. | 166/305 R |
| 3,791,447 | 2/1974 | Smith et al. | 166/311 |
| 4,941,349 | 7/1990 | Walkow et al. | 73/151 |
| 4,995,461 | 2/1991 | Sydansk | 166/295 |
| 5,287,741 | 2/1994 | Schultz et al. | 73/155 |
| 5,353,875 | 10/1994 | Schultz et al. | 166/297 |
| 5,377,757 | 1/1995 | Ng | 166/277 |

*Primary Examiner*—Hezron E. Williams
*Assistant Examiner*—J. David Wiggins
*Attorney, Agent, or Firm*—Henry N. Garrana; John H. Bouchard

[57] ABSTRACT

A new drill stem test apparatus and corresponding method includes a dual coaxial coiled tubing adapted to be disposed in the wellbore. The dual coaxial coiled tubing includes an inner coiled tubing, and an outer coiled tubing surrounding and enclosing the inner coiled tubing and forming an annular space which is located between the inner coiled tubing and the outer coiled tubing. The annular space is adapted to contain a pressurized kill fluid. A first end of the outer coiled tubing is sealed by a sealing element to a first end of the inner coiled tubing, the end of the inner coiled tubing extending beyond the sealing element and adapted to receive a formation fluid. The first ends of the inner and outer coiled tubing are disposed in a wellbore. A second end of the inner and outer coiled tubing is wound onto a coiled tubing reel and is connected to a kill fluid valve and a formation fluid valve. When the kill fluid valve opens while the formation fluid valve is closed, a pressurized kill fluid fills and pressurizes the annular space between the inner and outer coiled tubing. While the kill fluid valve is still open, the formation fluid valve is opened. A formation fluid begins to flow from the formation through the inner coiled tubing and through the formation fluid valve. If the inner coiled tubing forms a hole and begins to leak formation fluid, the pressurized kill fluid in the annular space will prevent the formation fluid in the inner coiled tubing from leaking out of the interior of the inner coiled tubing and into the annular space.

18 Claims, 3 Drawing Sheets

METHOD AND APPARATUS FOR TESTING WELLS USING DUAL COILED TUBING

BACKGROUND OF THE INVENTION

The subject matter of the present invention relates to a method and apparatus for running a dual coiled tubing test string into a wellbore, pumping a kill fluid into an annular space located between the two coiled tubing strings, and performing a drill stem test.

Coiled tubing is increasing in popularity in connection with wellbore operations simply because it is easier and less expensive to lower a coiled tubing into a wellbore instead of a production tubing. For example, U.S. Pat. No. 5,287,741 to Schultz et al discloses a method for performing a drill stem test by lowering a coiled tubing and an attached drill stem test tool string into a production tubing string in a wellbore. The disclosure of U.S Pat. No. 5,287,741 to Schultz et al is incorporated by reference into the specification of this application. Although the Schultz patent indicates (in column 8, line 15) that the coiled tubing has no connections to leak, the coiled tubing may, nevertheless, separate thereby forming a hole. When the coiled tubing is carrying a formation fluid, the formation fluid may begin to leak through the hole in the coiled tubing. The Schultz patent fails to disclose any method or apparatus for protecting the coiled tubing and containing the leak of the formation fluid which is leaking through the hole in the coiled tubing. Consequently, a new drill stem test apparatus is needed which utilizes a coiled tubing instead of a production tubing to lower a drill stem test tool string into a wellbore, and which further includes a separate containment apparatus for preventing a formation fluid from leaking through a hole in the coiled tubing. When the new drill stem test apparatus is used in a wellbore, a new method for performing a drill stem test could be practiced in the wellbore.

SUMMARY OF THE INVENTION

Accordingly, it is a primary object of the present invention to provide a new drill stem test (DST) apparatus adapted to be disposed in a wellbore for performing a drill stem test.

It is a further object of the present invention to provide a new drill stem test (DST) apparatus adapted to be disposed in a wellbore for performing a drill stem test, the new DST apparatus including a first coiled tubing and a second coiled tubing enclosing the first coiled tubing and forming an annular space between the first coiled tubing and the second coiled tubing.

It is a further object of the present invention to provide a new drill stem test (DST) apparatus adapted to be disposed in a wellbore for performing a drill stem test, the new DST apparatus including a first coiled tubing and a second coiled tubing sealed at its end to an end of the first coiled tubing and enclosing the first coiled tubing thereby forming an annular space between the first coiled tubing and the second coiled tubing, the ends of the first and second coiled tubings adapted to be disposed in the wellbore, the first coiled tubing receiving the formation fluid.

It is a further object of the present invention to provide a new drill stem test (DST) apparatus adapted to be disposed in a wellbore for performing a drill stem test, the new DST apparatus including a first coiled tubing and a second coiled tubing sealed at its end to an end of the first coiled tubing and enclosing the first coiled tubing thereby forming an annular space between the first coiled tubing and the second coiled tubing, and a kill fluid disposed within the annular space between the first and second coiled tubings, the ends of the first and second coiled tubings adapted to be disposed in the wellbore, the first coiled tubing receiving the formation fluid.

It is a further object of the present invention to provide a new method for performing a drill stem test.

It is a further object of the present invention to provide a new method for performing a drill stem test, the new drill stem test method including the steps of lowering a dual coaxial coiled tubing into a wellbore and performing a drill stem test.

It is a further object of the present invention to provide a new method for performing a drill stem test, the new drill stem test method including the steps of lowering a first coiled tubing and a second coaxially disposed coiled tubing into a wellbore and performing a drill stem test.

It is a further object of the present invention to provide a new method for performing a drill stem test, the new drill stem test method including the steps of lowering a first coiled tubing and a second coaxially disposed coiled tubing into a wellbore, an annular space existing between the first coiled tubing and the second coiled tubing, filling the annular space with a kill fluid, and performing a drill stem test.

It is a further object of the present invention to provide a new method for performing a drill stem test, the new drill stem test method including the steps of lowering a first coiled tubing and a second coaxially disposed coiled tubing into a wellbore, the second coiled tubing being sealed at one end to an end of the first coiled tubing and enclosing the first coiled tubing thereby forming an annular space between the first and second coiled tubing, the ends of the first and second coiled tubings being lowered into the wellbore; filling the annular space between the first and second coiled tubings with a kill fluid; and receiving a formation fluid into the end of the first coiled tubing.

These and other objects of the present invention are accomplished by providing a new drill stem test apparatus adapted to be disposed in a wellbore. When the new drill stem test apparatus is disposed in the wellbore, a new method for performing a drill stem test may be practiced.

The new drill stem test apparatus includes a dual coaxial coiled tubing adapted to be disposed in the wellbore. The dual coaxial coiled tubing includes a first coiled tubing, and a second coiled tubing surrounding and enclosing the first coiled tubing and forming an annular space between the first coiled tubing and the second coiled tubing. A first end of the second coiled tubing is sealed to a first end of the first coiled tubing. Although the first ends of the first and second coiled tubing are adapted to be disposed in a wellbore, the first end of the first coiled tubing is the only tubing which receives a formation fluid from a formation penetrated by the wellbore. A second end of the first coiled tubing is connected to a formation fluid valve via a coiled tubing reel, and a second end of the second coiled tubing is connected to a kill fluid valve via the coiled tubing reel. The new method for performing a drill stem test includes the steps of lowering the first end of the aforementioned dual coaxial coiled tubing into a wellbore, the first end of the first coiled tubing being adapted to receive the formation fluid from the formation. The kill fluid valve is opened. When the kill fluid valve is opened, a kill fluid begins to flow into the annular space between the first coiled tubing and the second coiled tubing. The kill fluid cannot leak out of the first end of the first and second coiled tubing because the first end of the second coiled tubing is sealed to the first end of the first coiled tubing. When the kill fluid fills the annular space and is pressurized to a predetermined pressure, the formation fluid valve, connected to the second end of the first coiled tubing, is opened. As a result, the formation fluid which is flowing into the first end of the first coiled tubing begins to flow uphole through the first coiled tubing and through the formation fluid valve. If the first coiled tubing separates and forms a hole, the formation fluid in the first coiled tubing will attempt to leak out of the hole in the first coiled tubing and into the annular space. However, the pressurized kill fluid which is present in the annular space between the first and second coiled tubing will prevent the formation fluid from leaking out of the hole from the interior of the first coiled tubing into the annular space. Consequently, the formation fluid will continue to flow uphole uninterrupted through the first coiled tubing and through the formation fluid valve.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
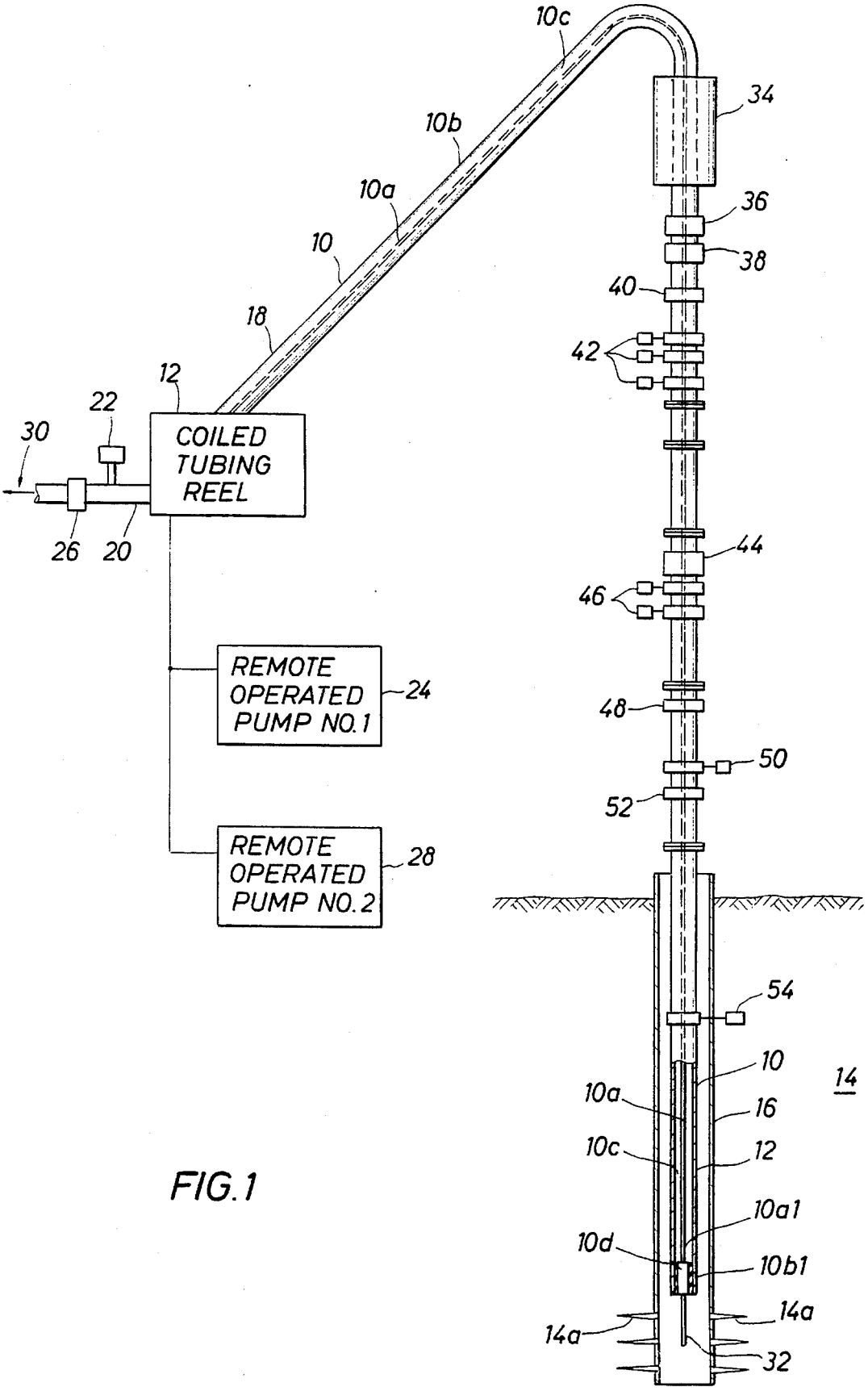
FIG. 1 illustrates a first embodiment of the new drill stem test method and apparatus of the present invention including the new dual coaxial coiled tubing string disposed in a wellbore.

Referring to FIG. 1, a new drill stem test apparatus in accordance with a first embodiment of the present invention is illustrated.

In FIG. 1, a dual coaxial coiled tubing 10 is wound upon a coiled tubing reel 12. The dual coaxial coiled tubing 10 includes an inner coiled tubing 10*a* and an outer coiled tubing 10*b* which encloses the inner coiled tubing 10*a* thereby forming an annular space 10*c* between the inner coiled tubing 10*a* and the outer coiled tubing 10*b*. When the dual coaxial coiled tubing 10 is rolled off the coiled tubing reel 12, a first end 12 of the dual coaxial coiled tubing 10 is disposed in a wellbore which is lined with a casing 16. The casing 16 penetrates an earth formation 14 traversed by the wellbore. A second end 18 of the dual coaxial coiled tubing 10 is wound upon the coiled tubing reel 12. The second end 18 is connected to a pipe 20. The pipe 20 is connected to a 3½ inch kill fluid valve 22 which is associated with a kill pump 24 and a 2 inch formation fluid valve 26 which is associated with a formation fluid pump 28. The kill fluid valve 22 is adapted to open a flow line between the pipe 20 and the annular space 10*c* which is disposed between the inner and outer coiled tubings 10*a* and 10*b*. However, the formation fluid valve 26 is adapted to open a flow line between an interior of the inner coiled tubing 10*a* and the pipe 20. When the kill fluid valve 22 is opened, the kill pump 24 will pump a kill fluid into the annular space 10*c* disposed between the inner coiled tubing 10*a* and the outer coiled tubing 10*b*. The kill fluid is heavier than the expected formation fluid which will flow from the formation 14 through the interior of the inner coiled tubing 10*a*. As a result, if a hole is formed in the inner coiled tubing 10*a*, the kill fluid, being heavier than the formation fluid, will prevent the formation fluid from leaking out of the hole from the interior of the inner coiled tubing 10*a* into the annular space 10*c*. However, when the formation fluid valve 26 is opened, a formation fluid flowing within the interior of the inner coiled tubing 10*a* will flow out of the inner coiled tubing 10*a* and through the pipe 20 in the direction of the arrow 30. The first end 12 of the dual coaxial coiled tubing 10 includes an end 10*b*1 of the outer coiled tubing 10*b*, an end 10*a*1 of the inner coiled tubing 10*a*, and a sealing element 10*d* which seals the end 10*b*1 of the outer coiled tubing 10*b* to the end 10*a*1 of the inner coiled tubing 10*a*. The sealing element 10*d* may comprise either a polished rod or a sealing slip joint. When the sealing element 10*d* seals the end 10*b*1 to the end 10*a*1 of the outer and inner coiled tubings, if a formation fluid begins to flow from a plurality of perforations 14*a* in the formation 14, the formation fluid cannot enter the annular space 10*c* disposed between the inner and outer coiled tubings 10*a* and 10*b*. In FIG. 1, a drill stem test string 32 protrudes from an end of the sealing element 10*c*. In our example shown in FIG. 1, the drill stem test string 32 actually forms a part of the inner coiled tubing 10*a*. However, the inner coiled tubing 10*a* which comprises the drill stem test string 32 of FIG. 1 could easily be connected to a number of other drill stem test tools, such as the tools shown in FIG. 1B of U.S. Pat. No. 5,287,741 to Schultz et al. These other tools would include a reverse circulating valve, a tester valve, a sampler, a gauge carrier, and/or a straddle packer. In FIG. 1, the dual coaxial coiled tubing 10 also includes an injector head 34, an upper stripper 36, a lower stripper 38, a quick connector 40, an upper coiled tubing blowout preventer 42, a coiled tubing annular blowout preventer 44, a lower coiled tubing blowout preventer 46, a swab valve 48, a hydraulic master valve 50, a manual master valve 52, and a hydraulic subsurface safety valve 54. When the kill fluid valve 22 is opened, the kill fluid will be pumped by kill pump 24 into the entire length of the annular space 10*c*, disposed between the inner and outer coiled tubings 10*a* and 10*b* of FIG. 1.

Figures 2, 3:
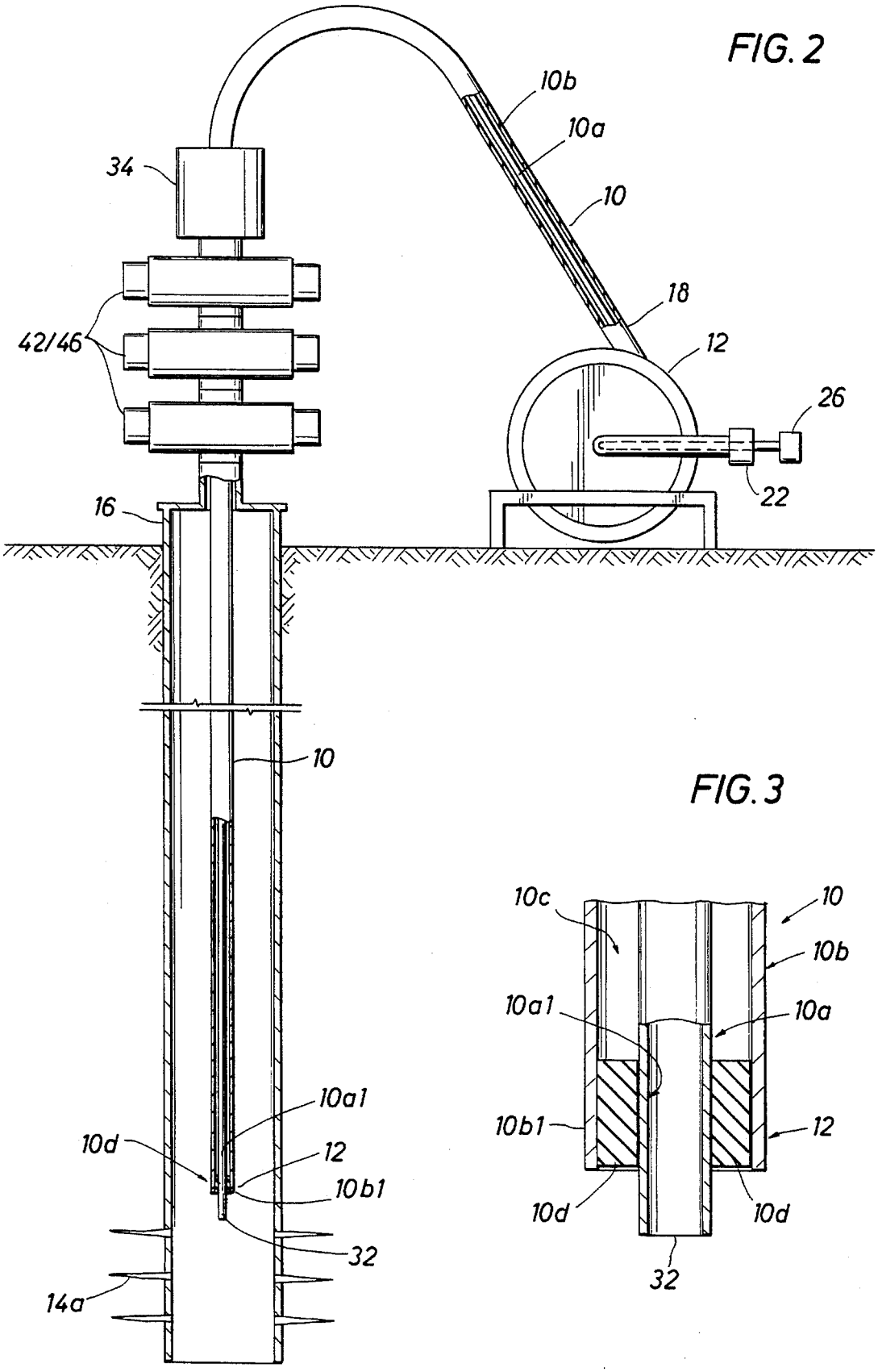
FIG. 2 illustrates a second embodiment of the new drill stem test method and apparatus of the present invention.
FIG. 3 illustrates an exploded section of a portion of the dual coaxial coiled tubing of FIG. 2 illustrating the inner coiled tubing, the outer coiled tubing, a sealing element, and the annular space between the inner and outer coiled tubing.

Referring to FIGS. 2 and 3, the new drill stem test apparatus in accordance with a second embodiment of the present invention is illustrated. FIG. 2 illustrates a dual coaxial coiled tubing string, in accordance with a second embodiment of the present invention, disposed in a wellbore for use during the practice of a new method, also in accordance with the present invention, for performing drill stem test. FIG. 3 illustrates an exploded section of a portion of the dual coaxial coiled tubing of FIG. 2 illustrating the inner coiled tubing, the outer coiled tubing, a sealing element, and the annular space between the inner and outer coiled tubing. In FIGS. 2 and 3, the element numerals used in FIG. 1 will be used in FIGS. 2 and 3 wherever possible.

In FIGS. 2 and 3, the second embodiment of the new drill stem test apparatus of the present invention is basically the same as the first embodiment shown in FIG. 1. The second end 18 of the dual coaxial coiled tubing 10 is wound upon the coiled tubing reel 12 as shown in FIG. 1 and the first end 12 of the dual coiled tubing 10 is situated in the casing string 16 of the wellbore. The drill stem test apparatus of FIG. 2 also includes the injector head 34 and the coiled tubing blowout preventors 42/46. As best shown in FIG. 3, the outer coiled tubing 10*b* encloses the inner coiled tubing 10*a* and forms an annular space 10*c* between the outer and inner coiled tubing. In FIG. 2, the annular space 10*c* is connected to the kill fluid valve 22. When the kill fluid valve 22 is opened, a pressurized kill fluid begins to flow into the annular space 10*c* between the outer and inner coiled tubing 10*b* and 10*a*, respectively. However, in FIG. 3, the first end 12 of the dual coaxial coiled tubing 10 includes an outer coiled tubing end 10*b*1 and an inner coiled tubing end 10*a*1, the two ends 10*b*1 and 10*a*1 being sealed together by the sealing element 10*d*. The sealing element 10*d* can be either a sliding seal assembly, polished rod, or a welded joint. Therefore, when the kill fluid valve 22 is opened and the kill fluid begins to flow into the annular space 10*c*, in view of the sealing element 10*d* of FIG. 3, the kill fluid will not flow out of the first end 12 of the dual coiled tubing 10. The kill fluid between the inner and outer coiled tubing 10*a* and 10*b* can be used in the following manner: (1) fill the annular space 10*c* with the kill fluid and remove all air; monitor the kill fluid with a pressure readout at the surface of the wellbore to determine if there is any indication of a leak in the inner coiled tubing 10*a*, or (2) fill the annular space 10*c* with the kill fluid and pressurize the kill fluid to a desired, predetermined pressure to reduce the burst stress on the inner coiled tubing 10*a*; continue to monitor the kill fluid to determine if a hole in the inner coiled tubing 10*a* produces a leak from the inner coiled tubing; if a leak from the inner coiled tubing 10*a* occurs, increase the pressure of the kill fluid in the annular space 10*c* to control the leak. When formation fluid is produced from the perforations 14*a* in the formation, the formation fluid will be forced to enter the drill stem test string 32 of FIG. 3, which in the example of FIGS. 2–3, consists of the first end 12 of the inner coiled tubing 10*a*. However, recall again that the end of the inner coiled tubing 10*a* of the drill stem test string 32 of FIG. 3 could easily be connected to other drill stem test tools, such as a reverse circulating valve, a tester valve, a sampler, a gauge carrier, and/or a straddle packer.

Figures 4, 5:
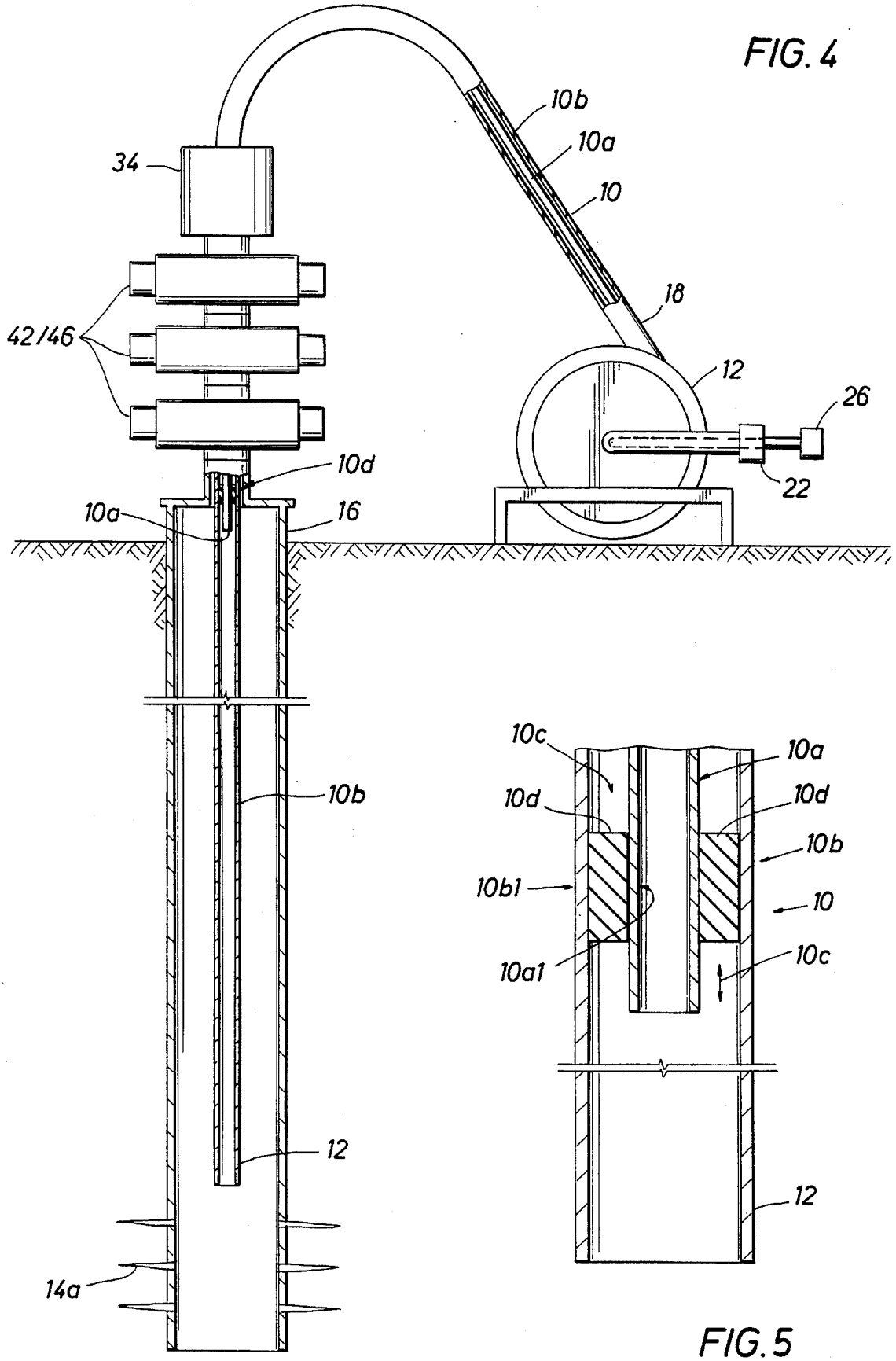
FIG. 4 illustrates a third embodiment of the new drill stem test method and apparatus of the present invention.
FIG. 5 illustrates an exploded section of a portion of the dual coaxial coiled tubing of FIG. 4 illustrating the inner coiled tubing, the outer coiled tubing, a sealing element, and the annular space between the inner and outer coiled tubing.

Referring to FIGS. 4 and 5, the new drill stem test apparatus in accordance with a third embodiment of the present invention is illustrated. FIG. 4 illustrates a dual coaxial coiled tubing string, in accordance with a third embodiment of the present invention, disposed in a wellbore for use during the practice of a new method, also in accordance with the present invention, for performing drill stem test. FIG. 5 illustrates an exploded section of a portion of the dual coaxial coiled tubing of FIG. 4 illustrating the inner coiled tubing, the outer coiled tubing, a sealing element, and the annular space between the inner and outer coiled tubing. In FIGS. 4 and 5, the element numerals used in FIG. 1 will be used in FIGS. 4 and 5 wherever possible.

In FIGS. 4 and 5, the drill stem test apparatus of FIG. 4 is basically the same as the drill stem test apparatus of FIGS. 2 and 3. However, the major difference between the drill stem test apparatus of FIGS. 2 and 4 relates to the location of the sealing element 10*d*. In FIG. 2, the sealing element 10*d* was located adjacent to the drill stem test string 32 (the end of the inner coiled tubing 10*a*) and adjacent to the perforations 14*a* in the formation. However, in FIG. 4, the sealing element 10*d* is located adjacent the first end of the inner coiled tubing 10*a* which is located just below the blow out preventors 42/46; however, in FIG. 4, the first end 12 of the outer coiled tubing 10*b* extends far beyond the first end of the inner coiled tubing 10*a*.

In FIG. 4, the new drill stem test apparatus includes the dual coaxial coiled tubing 10 disposed in a wellbore for performing a new drill stem test. As shown in FIG. 5, the dual coaxial coiled tubing 10 includes the inner coiled tubing 10*a* which is enclosed by the outer coiled tubing 10*b*, and the annular space 10*c* disposed between the inner and outer coiled tubing. The second end 18 of the dual coaxial coiled tubing 10 is wound on the coiled tubing reel 12 and the first end 12 of the dual coiled tubing 10 is disposed in the wellbore. As mentioned earlier, the drill stem test apparatus also includes the injector head 34 and the blowout preventors 42/46. When the kill fluid valve 22 is opened, a pressurized kill fluid enters the annular space 10*c*, which is best shown in FIG. 5. However, the sealing element 10*d* of FIG. 5 will prevent the kill fluid in the annular space 10*c* from spilling out the annular space 10*c* and out of the end of the outer coiled tubing. When the formation fluid from the perforations 14*a* enter the outer coiled tubing 10*b*, and when the formation fluid valve 26 is opened, the formation fluid in the inner coiled tubing 10*a* will flow uphole within the inner coiled tubing 10*a* and through the formation fluid valve 26. If a hole forms in the inner coiled tubing 10*a*, the formation fluid will not leak from the interior of the inner coiled tubing 10*a* and through the hole into the annular space 10*c* because the pressurized kill fluid, which is located in the annular space 10*c*, will prevent the formation fluid from leaking through the hole. The formation fluid will continue to flow through inner coiled tubing 10*a* and through the formation fluid valve 26.

The new drill stem test method of the present invention will be described below in the following paragraphs with reference to the new drill stem test apparatus of the present invention which is shown in FIGS. 1 through 5 of the drawings.

The new drill stem test apparatus of the present invention is set up in the wellbore in the manner shown, for example, in FIG. 1. The dual coaxial coiled tubing string, consisting of two concentrically disposed coiled tubing strings separated by an annular space 10*c*, is wound off the coiled tubing reel 12 and a first end is disposed in a wellbore lined by a casing 16. The kill fluid valve 22 is opened, but the formation fluid valve 26 remains closed. A kill fluid, which is heavier than the expected formation fluid, begins to flow from the kill fluid valve 22 and into the annular space 10*c* between the outer coiled tubing 10*b* and the inner coiled tubing 10*a*. The sealing element 10*d* will prevent the kill fluid in the annular space 10*c* from spilling out the other end of the annular space 10*c* and out of the dual coaxial coiled tubing 10 and into the wellbore. The kill fluid is pressurized to a predetermined pressure. Then, the formation fluid valve 26 is opened. Formation fluid from the perforations 14*a* in the formation begins to flow into the first end 12 of the inner coiled tubing 10*a*. Since the formation fluid valve 26 is opened, the formation fluid will flow through the inner coiled tubing 10*a* and through the formation fluid valve 26 at the surface of the wellbore. Assume that a hole forms in the wall of the inner coiled tubing 10*a*. The formation fluid inside the inner coiled tubing 10*a* will attempt to leak out of the hole and into the annular space 10*c*. However, since the pressurized kill fluid is located in the annular space 10*c* and since it is heavier than the formation fluid, the kill fluid in the annular space 10*c* will prevent the formation fluid in the inner coiled tubing 10*a* from leaking out from the interior of the inner coiled tubing 10*a*, through the hole, and into the annular space 10*c*. The flow of the formation fluid in the inner coiled tubing 10*a* will not be interrupted; rather, the formation fluid will continue to flow out of the formation fluid valve 26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A drill stem test apparatus adapted to be disposed in a wellbore, comprising:

an inner coiled tubing adapted to flow a formation fluid through an interior thereof and adapted to form a hole disposed through a wall of said inner coiled tubing;

an outer coiled tubing enclosing the inner coiled tubing and forming an annular space between the inner coiled tubing and the outer coiled tubing; and a pressurized kill fluid disposed within said annular space, the pressure of said kill fluid .preventing said formation fluid in said inner coiled tubing from flowing from said interior into said annular space via said hole.

2. The drill stem test apparatus of claim 1, wherein the inner coiled tubing and the outer coiled tubing have walls and each include both a near end and a distant end relative to a surface of the wellbore, the drill stem test apparatus further comprising:

a sealing element disposed between the walls at the distant ends of the inner coiled tubing and the outer coiled tubing and sealing the distant end of the outer coiled tubing to the distant end of the inner coiled tubing, a distant end of said annular space being closed when said sealing element seals the distant end of the outer coiled tubing to the distant end of the inner coiled tubing.

3. The drill stem test apparatus of claim 2, further comprising:

a first valve connected to the near end of the outer coiled tubing and in fluid communication with said annular space adapted for opening and flowing said kill fluid therethrough into said annular space and closing, the pressurized kill fluid flowing through said first valve and into a near end of said annular space when said first valve is open, the near end of said annular space being closed when said first valve is closed; and a second valve connected to the near end of said inner coiled tubing and in fluid communication with an interior of said inner coiled tubing adapted for opening and flowing said formation fluid from said interior and into said second valve and closing, said near end of said inner coiled tubing being closed when said second valve is closed.

4. A method of performing a drill stem test in a wellbore with a kill fluid, comprising the steps of:

lowering an end of a dual coiled tubing into a wellbore, the dual coiled tubing having a near end and a distant end relative to a surface of said wellbore and including an inner coiled tubing, an outer coiled tubing enclosing said inner coiled tubing and forming an annular space between said outer coiled tubing and said inner coiled tubing, and a sealing element disposed between and sealing an inner diameter at the distant end of said outer coiled tubing to an outer diameter at the distant end of said inner coiled tubing;

filling said annular space bounded on one side by said sealing element with said kill fluid, and pressurizing said kill fluid in said annular space; and receiving a formation fluid into the distant end of said inner coiled tubing.

5. The method of claim 4, wherein a first valve is connected to the near end of said outer coiled tubing, said first valve being adapted to close and to open and, when open, to allow a fluid communication between said near end of said outer coiled tubing and said annular space, and wherein the step of filling said annular space includes the step of:

opening said first valve thereby opening said fluid communication between said near end of said outer coiled tubing and said annular space and flowing said kill fluid through said first valve, through said near end of said outer coiled tubing, and into said annular space; and when said first valve is open, pressurizing said kill fluid in said annular space.

6. The method of claim 5, wherein a second valve is connected to the near end of said inner coiled tubing, said second valve being adapted to close and to open and, when open, to allow a fluid communication between an interior of said inner coiled tubing and said near end of said inner coiled tubing, and wherein the step of receiving a formation fluid includes the steps of:

opening said second valve thereby opening said fluid communication between said interior of said inner coiled tubing and said near end of said inner coiled tubing; and receiving said formation fluid into the distant end of said inner coiled tubing, said formation fluid flowing from said distant end into said interior of said inner coiled tubing, said formation fluid flowing from said interior, through said near end of said inner coiled tubing, and through said second valve.

7. A drill stem test apparatus adapted to be disposed in a wellbore, a formation fluid being adapted to flow from a formation penetrated by said wellbore, comprising:

a first coiled tubing;

a second coiled tubing disposed around and enclosing said first coiled tubing and forming an annular space between the first coiled tubing and the second coiled tubing, the first and the second coiled tubing each having a near and and a distant end relative to a surface of the wellbore, the distant ends of the first and second coiled tubing being adapted to be disposed in said wellbore;

a sealing element disposed between and sealing an outer diameter of the distant end of the first coiled tubing to an inner diameter of the distant end of the second coiled tubing, the distant end of said first coiled tubing extending beyond said sealing element, said formation fluid adapted to flow from said formation into said distant end of said first coiled tubing; and a kill fluid disposed in said annular space between said first coiled tubing and said second coiled tubing.

8. The drill stem test apparatus of claim 7, further comprising:

a first valve connected to the near end of said second coiled tubing adapted for opening and closing, said first valve opening and allowing a fluid communication between said near end of said second coiled tubing and said annular space.

9. The drill stem test apparatus of claim 8, wherein, when said first valve opens and allows said fluid communication between said near end of said second coiled tubing and said annular space, said kill fluid flows under pressure through said first valve, through the near end of said second coiled tubing, and into said annular space.

10. The drill stem test apparatus of claim 9, further comprising:

a second valve connected to the near end of said first coiled tubing adapted for opening and closing, said second valve opening and allowing a fluid communication between said near end of said first coiled tubing and an interior space of said first coiled tubing.

11. The drill stem test apparatus of claim 10, wherein, when said second valve opens and allows said fluid communication between said near end of said first coiled tubing and said interior space, said formation fluid flows from said formation and into said distant end of said first coiled tubing.

12. The drill stem test apparatus of claim 11, further comprising:

a hole in said first coiled tubing, the pressurized kill fluid in said annular space between the first coiled tubing and the second coiled tubing preventing said formation fluid in said first coiled tubing from flowing from said first coiled tubing, through said hole, and into said annular space.

13. A method of performing a wellbore operation in a wellbore, comprising the steps of:

(a) lowering a dual coiled tubing into a wellbore, the dual coiled tubing including an inner coiled tubing and an outer coiled tubing enclosing the inner coiled tubing and forming an annular space between the inner coiled tubing and the outer coiled tubing, said inner coiled tubing adapted to form a hole disposed through a wall of said inner coiled tubing;

(b) flowing a pressurized kill fluid in said annular space; and (c) flowing a formation fluid through an interior of said inner coiled tubing, the pressure of said kill fluid in said annular space preventing said formation fluid in said inner coiled tubing from flowing from said interior, through said hole, and into said annular space.

14. The method of claim 13, wherein the inner and outer coiled tubing of said dual coiled tubing each have a near end and a distant end relative to a surface of said wellbore, further comprising the steps of:

(d) sealing an inner diameter of the distant end of said outer coiled tubing to an outer diameter of the distant end of said inner coiled tubing, the seal at the distant end of said dual coiled tubing preventing the pressurized kill fluid in said annular space from flowing from said annular space and out said distant end of the dual coiled tubing.

15. The method of claim 14, wherein the flowing step (b) comprises the steps of:

(e) opening a first valve connected to the near end of said outer coiled tubing and disposed in fluid communication with the near end of said outer coiled tubing and said annular space; and (f) when the first valve is opened, flowing said pressurized kill fluid through said first valve, into said near end of said outer coiled tubing and into said annular space, the seal at the distant end of said dual coiled tubing preventing the pressurized kill fluid in said annular space from flowing from said annular space and out said distant end of the dual coiled tubing.

16. The method of claim 15, wherein the flowing step (c) comprises the steps of:

(g) opening a second valve connected to the near end of said inner coiled tubing and disposed in fluid communication with the near end of said inner coiled tubing and an interior of said inner coiled tubing; and (h) when the second valve is opened, flowing said formation fluid from said formation through the distant end of said inner coiled tubing, through an interior of said inner coiled tubing, through the near end of said inner coiled tubing, and through said second valve.

17. An apparatus adapted to be disposed in a wellbore, comprising:

a first coiled tubing;

a second coiled tubing enclosing said first coiled tubing and forming an annular space between the first and second coiled tubing, the first and second coiled tubing each having a near end adapted to be disposed at a surface of the wellbore and a distant end adapted to be disposed in said wellbore;

a sealing element disposed between and sealing an inner diameter of the distant end of said second coiled tubing to an outer diameter of the distant end of said first coiled tubing, the distant end of the first coiled tubing extending beyond said sealing element and adapted to receive a formation fluid from a formation penetrated by said wellbore; and a kill fluid disposed within said annular space.

18. The apparatus of claim 17, further comprising:

a first valve connected to the near end of said second coiled tubing in fluid communication with said annular space adapted for opening and filling said annular space with said kill fluid; and a second valve connected to the near end of said first coiled tubing in fluid communication with an interior of said first coiled tubing adapted for opening and flowing said formation fluid received in said distant end of said first coiled tubing through said second valve.

* * * * *